US011794046B1

(12) United States Patent
Oilar

(10) Patent No.: US 11,794,046 B1
(45) Date of Patent: Oct. 24, 2023

(54) FIRE HOSE SUPPORT ASSEMBLY

(71) Applicant: Douglas Oilar, Corning, CA (US)

(72) Inventor: Douglas Oilar, Corning, CA (US)

( * ) Notice: Subject to any disclaimer, the term of this patent is extended or adjusted under 35 U.S.C. 154(b) by 0 days.

(21) Appl. No.: 17/744,235

(22) Filed: May 13, 2022

(51) Int. Cl.
*A62C 33/04* (2006.01)

(52) U.S. Cl.
CPC ..... *A62C 33/04* (2013.01)

(58) Field of Classification Search
None
See application file for complete search history.

(56) References Cited

U.S. PATENT DOCUMENTS

| | | | | | |
|---|---|---|---|---|---|
| 1,425,067 | A * | 8/1922 | Stone | B05B 15/622 | 248/412 |
| 1,631,849 | A * | 6/1927 | Arnt | B05B 15/625 | 248/82 |
| 1,649,649 | A * | 11/1927 | Bank | B05B 15/625 | 239/280.5 |
| 1,873,672 | A | 8/1932 | Theys | | |
| 2,309,772 | A * | 2/1943 | Karger | B05B 15/625 | 248/82 |
| 2,446,723 | A * | 8/1948 | Schaechterle | A01G 25/00 | 248/81 |
| 2,495,995 | A * | 1/1950 | Warrens | F16M 11/22 | 248/82 |
| 3,603,539 | A | 9/1971 | Clegg, Jr. | | |
| 5,755,470 | A | 5/1998 | Schempp | | |
| 6,003,819 | A | 12/1999 | Hall | | |
| 6,983,915 | B2 * | 1/2006 | Adelman | F16M 11/245 | 248/188.7 |
| 10,798,888 | B2 * | 10/2020 | Kosla | B05B 15/622 | |
| 2003/0071177 | A1 * | 4/2003 | Aussiker | F16M 11/046 | 248/125.8 |
| 2005/0184203 | A1 * | 8/2005 | Votypka | B05B 15/622 | 248/87 |

FOREIGN PATENT DOCUMENTS

| | | |
|---|---|---|
| CA | 2388168 | 6/2002 |
| GB | 2315312 | 1/1998 |

* cited by examiner

*Primary Examiner* — Steven M Marsh

(57) ABSTRACT

A fire hose support assembly for inhibiting a fire hose from kinking includes a pole that has a plurality of telescopic sections such that the pole has a telescopically adjustable length. The plurality of telescopic sections includes a lower section, a middle section and an upper section. A trough is pivotally attached to the pole and the trough has a concave profile to conform to the shape of a fire hose. The pole is vertically oriented on a support surface having the trough being spaced upwardly from the support surface. In this way the trough can support the fire hose in a manner that inhibits the fire hose from kinking when the fire hose is attached to a fire engine.

7 Claims, 3 Drawing Sheets

FIRE HOSE SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fire hose device and more particularly pertains to a new fire hose device for inhibiting a fire hose from kinking. The device includes a pole that has a telescopically adjustable height. The device includes a trough that includes a pivot which pivotally engages the pole. The pole is vertically oriented on a support surface thereby facilitating the trough to support a fire hose that is attached to a fire engine. In this way the trough inhibits the fire hose from kinking and restricting a flow of water through the fire hose.

(2) Description of Related Art Including Information Disclosed Under 37 CFR 1.97 and 1.98

The prior art relates to fire hose devices including a variety of grapple devices that each has a pair of concave jaws for gripping a hose. The prior art discloses an A-frame stand that has a channel for supporting a fire hose. The prior art discloses a clamp for a fuel hose that includes a concave channel for supporting the fuel hose and a clamp that extends around the fuel hose. The prior art discloses a fire hose manipulating device that includes a lever that is pivotally coupled to a gripping member which includes a trough for receiving a fire hose thereby facilitating the lever to be manipulated for maneuvering the fire hose. The prior art discloses a sewer hose trough that has a pair of telescopic sections for supporting a sewer hose of a recreational vehicle.

BRIEF SUMMARY OF THE INVENTION

An embodiment of the disclosure meets the needs presented above by generally comprising a pole that has a plurality of telescopic sections such that the pole has a telescopically adjustable length. The plurality of telescopic sections includes a lower section, a middle section and an upper section. A trough is pivotally attached to the pole and the trough has a concave profile to conform to the shape of a fire hose. The pole is vertically oriented on a support surface having the trough being spaced upwardly from the support surface. In this way the trough can support the fire hose in a manner that inhibits the fire hose from kinking when the fire hose is attached to a fire engine.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
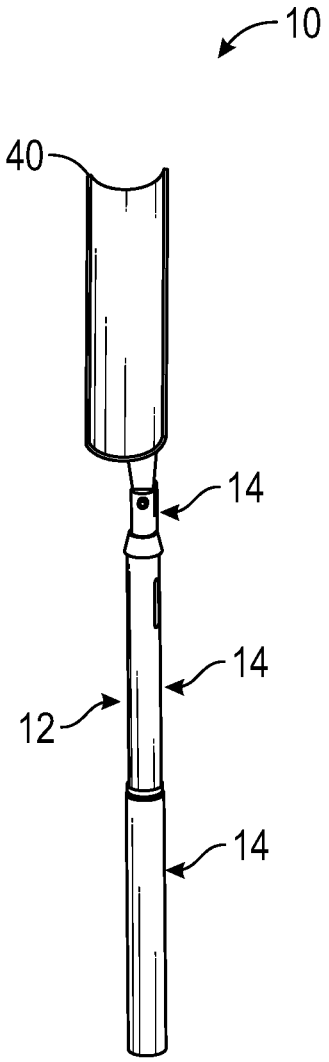
FIG. 1 is a front view of a fire hose support assembly according to an embodiment of the disclosure.
Figure 2:
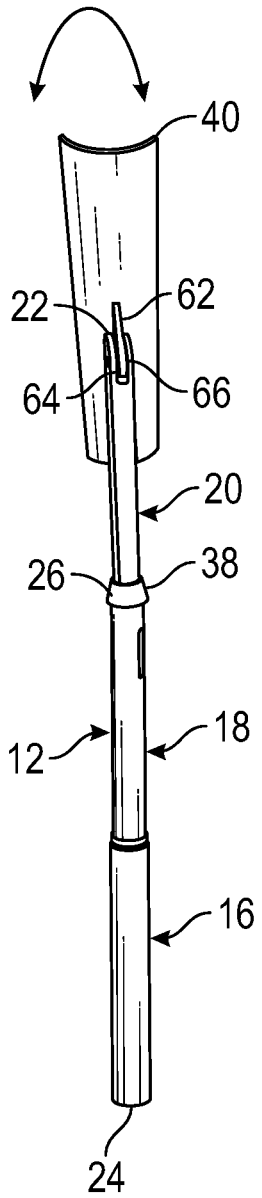
FIG. 2 is a back view of an embodiment of the disclosure.
Figure 3:
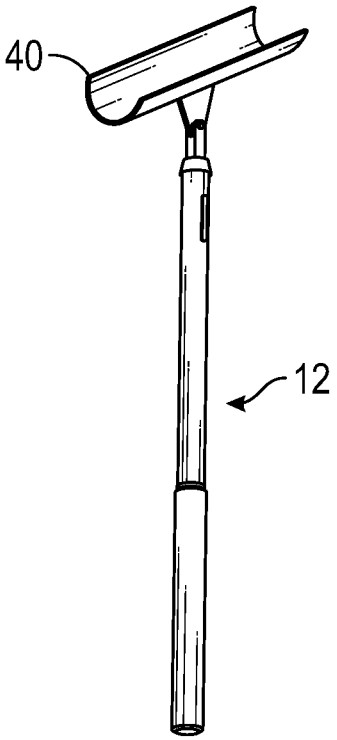
FIG. 3 is a right side view of an embodiment of the disclosure.
Figure 4:
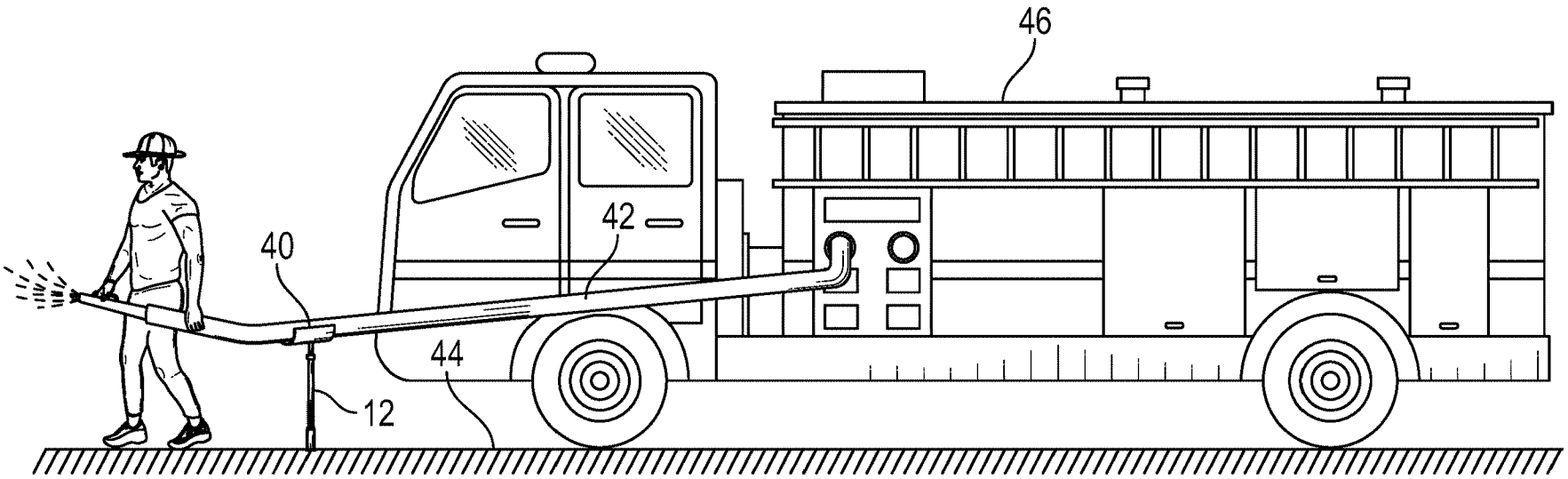
FIG. 4 is a perspective in-use view of an embodiment of the disclosure.
Figure 5:
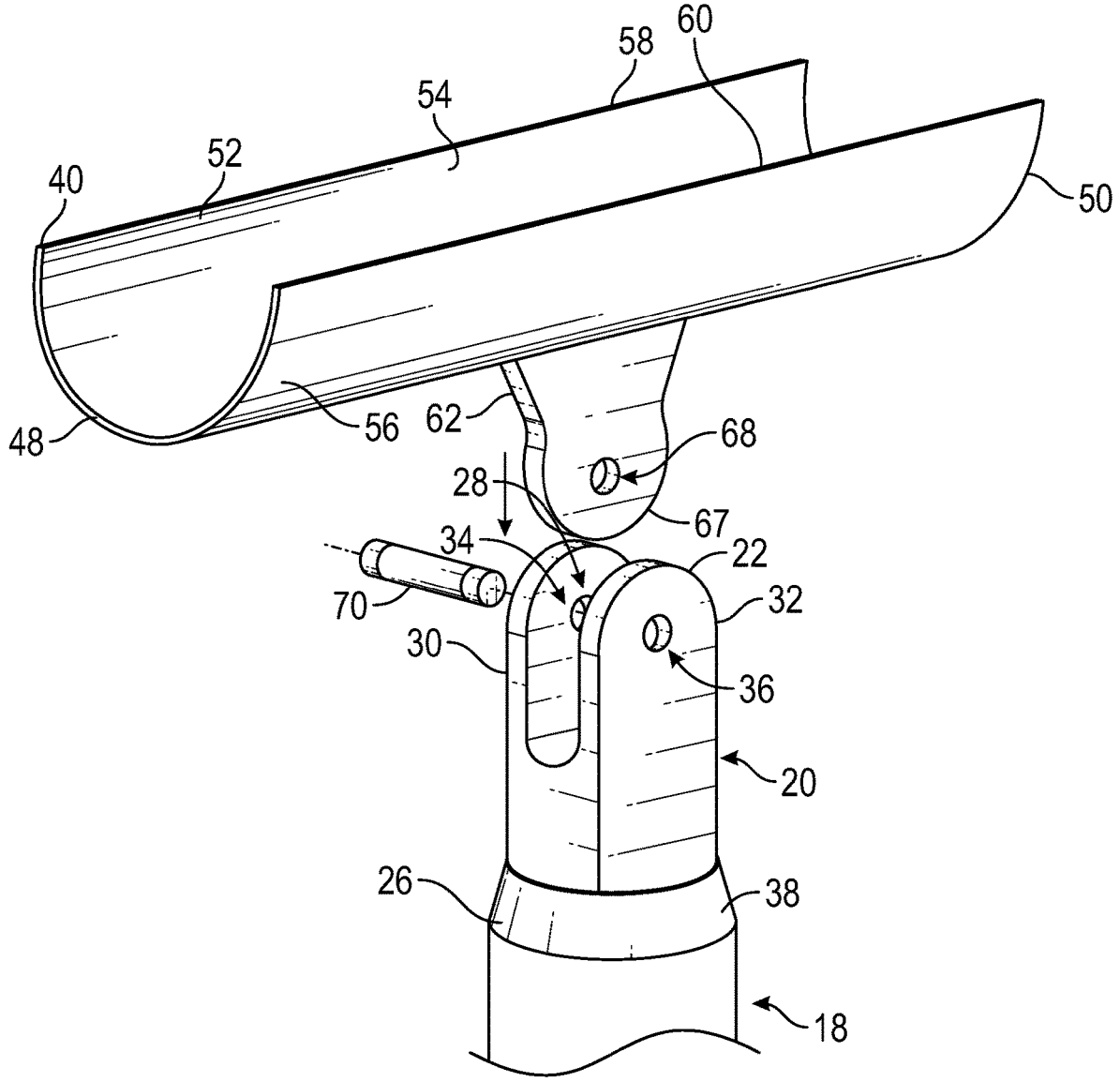
FIG. 5 is an exploded perspective view of a trough and a pole of an embodiment of the disclosure.

With reference now to the drawings, and in particular to FIGS. 1 through 5 thereof, a new fire hose device embodying the principles and concepts of an embodiment of the disclosure and generally designated by the reference numeral 10 will be described.

As best illustrated in FIGS. 1 through 5, the fire hose support assembly 10 generally comprises a pole 12 that has a plurality of telescopic sections 14 such that the pole 12 has a telescopically adjustable length. The plurality of telescopic sections 14 may include a lower section 16, a middle section 18 and an upper section 20. The pole 12 has an upper end 22 and a lower end 24; the upper end 22 is associated with the upper section and the lower end 24 is associated with the lower section 16. The lower section 16 and the middle section 18 are fixed with respect to each other, and the lower section 16 has a diameter that is greater than a diameter of the upper section 20. Additionally, the middle section 18 has a top end 26 insertably receiving the upper section 20.

The upper end 22 is rounded and the upper end 22 has a slot 28 extending toward the middle section 18 to define a first finger 30 that is spaced from a second finger 32 on the upper end 22. The first finger 30 has a first hole 34 extending laterally through the first finger 30. The second finger 32 has a second hole 36 extending laterally through the second finger 32. Furthermore, the first hole 34 is aligned with the second hole 36. A collar 38 is rotatably integrated into the top end 26 of the middle section 18 and the collar 38 extends around the upper section 20. The collar 38 tightens against the upper section when the collar 38 is rotated in a tightening direction. Conversely, the collar 38 loosens from the upper section 20 when the collar 38 is rotated in a loosening direction.

A trough 40 is pivotally attached to the pole 12 and the trough 40 has a concave profile such that the trough 40 can conform to the shape of a fire hose 42. The pole 12 is vertically oriented on a support surface 44 having the trough 40 being spaced upwardly from the support surface 44. In this way the trough 40 can support the fire hose 42 in a manner that inhibits the fire hose 42 from kinking when the fire hose 42 is attached to a fire engine 46. The trough 40 has a first end 48, a second end 50 and an outer wall 52 extending between the first end 48 and the second end 50, and the outer wall 52 has a top side 54 and a bottom side 56.

The outer wall 52 has a first edge 58 extending between the first end 48 and the second end 50, and the outer wall 52 has a second edge 60 extending between the first end 48 and the second end 50. The trough 40 is elongated between the first end 48 and the second end 50, and the outer wall 52 is concavely arcuate between the first edge 58 and the second edge 60 such that the first edge 58 is spaced from the second edge 60. The trough 40 has a pivot 62 extending downwardly from the bottom side 56 of the outer wall 52, and the pivot 62 is centrally positioned between the first end 48 and the second end 50. Additionally, the pivot 62 is centrally positioned between the first edge 58 and the second edge 60.

The pivot 62 has a first lateral side 64, a second lateral side 66 and a distal end 67 with respect to the bottom side 56 of the outer wall 52. The distal end 67 is rounded and the pivot 62 has an opening 68 extending through the first lateral side 64 and the second lateral side 66. The pivot 62 is positionable in the slot 28 in the upper end 22 of the upper section 20 of the pole 12. Additionally, the opening 68 is aligned with each of the first hole 34 in the first finger 30 and the second hole 36 in the second finger 32. In this way the trough 40 is oriented such that the top side 54 of the outer wall 52 can support the fire hose 42.

A pin 70 is extendable through the first hole 34 in the first finger 30 and the second hole 36 in the second finger 32 and the opening 68 in the pivot 62 for pivotally attaching the trough 40 to the pole 12. The trough 40 pivots on the pin 70 for positioning the trough 40 at a variety of angles with respect to an axis extending through the lower end 24 and the upper end 22 of the pole 12. In this way the trough 40 positions the fire hose 42 at an optimal orientation to inhibit the fire hose 42 from kinking.

In use, the lower end 24 of the pole 12 is positioned on the support surface 44 and the fire hose 42 is positioned in the trough 40. The pole 12 is adjusted to a desired height and the collar 38 rotated in the tightening direction to retain the pole 12 at the desired height. In this way the fire hose 42 can be oriented to extend in a straight line with respect to an outlet 72 of the fire engine 46 to which the fire hose 42 is attached. Additionally, the trough 40 pivots on the pin 70 when the fire hose 42 is positioned in the trough 40 for supporting the fire hose 42 at the optimal orientation. In this way the fire hose 42 is inhibited from being kinked and restricting the flow of water through the fire hose 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fire hose support assembly for supporting a fire hose when the fire hose is attached to a fire engine, said assembly comprising:

a pole having a plurality of telescopic sections such that said pole has a telescopically adjustable length, said plurality of telescopic sections including a lower section, a middle section and an upper section; and a trough being pivotally attached to said pole, said trough having a concave profile wherein said trough is configured to conform to the shape of a fire hose, said pole being vertically oriented on a support surface having said trough being spaced upwardly from the support surface wherein said trough is configured to support the fire hose in a manner that inhibits the fire hose from kinking when the fire hose is attached to a fire engine; and wherein said trough has a first end, a second end and an outer wall extending between said first end and said second end, said outer wall having a top side and a bottom side, said outer wall having a first edge extending between said first end and said second end, said outer wall having a second edge extending between said first end and said second end, said trough being elongated between said first end and said second end, said outer wall being concavely arcuate between said first edge and said second edge such that said first edge is spaced from said second edge, said first edge and said second edge each being straight between said first end and said second end such that said first edge and said second edge are coplanar.

2. The assembly according to claim 1, wherein:

said pole has an upper end and a lower end, said upper end being associated with said upper section, said lower end being associated with said lower section;

said lower section has a diameter being greater than a diameter of said upper section;

said middle section has a top end insertably receiving said upper section;

said upper end is rounded; and said upper end has a slot extending toward said middle section to define a first finger being spaced from a second finger on said upper end, said first finger having a first hole extending laterally through said first finger, said second finger having a second hole extending laterally through said second finger, said first hole being aligned with said second hole.

3. The assembly according to claim 2, further comprising a collar being rotatably integrated into said top end of said middle section, said collar extending around said upper section, said collar tightening against said upper section when said collar is rotated in a tightening direction, said collar loosening from said upper section when said collar is rotated in a loosening direction.

4. The assembly according to claim 1, wherein:

said pole has an upper end and a lower end, said upper end being associated with said upper section;

said upper end has a slot extending toward said middle section to define a first finger being spaced from a second finger on said upper end, said first finger having a first hole extending laterally through said first finger, said second finger having a second hole extending laterally through said second finger, said first hole being aligned with said second hole; and said trough has a pivot extending downwardly from said bottom side of said outer wall, said pivot being centrally positioned between said first end and said second end, said pivot being centrally positioned between said first edge and said second edge, said pivot having a first lateral side and a second lateral side, said pivot having an opening extending through said first lateral side and said second lateral side, said pivot being positionable in said slot in said upper end of said of said upper section of said pole having said opening being aligned with each of said first hole in said first finger and said second hole in said second finger wherein said top side of said outer wall is configured to support the fire hose.

5. The assembly according to claim 4, further comprising a pin being extendable through said first hole in said first finger and said second hole in said second finger and said opening in said pivot for pivotally attaching said trough to said pole, said trough pivoting on pin for positioning said trough at a variety of angles with respect to an axis extending through said lower end and said upper end of said pole wherein said trough is configured to position the fire hose at an optimal orientation to inhibit the fire hose from kinking.

6. A fire hose support assembly for supporting a fire hose when the fire hose is attached to a fire engine, said assembly comprising:

a pole having a plurality of telescopic sections such that said pole has a telescopically adjustable length, said plurality of telescopic sections including a lower section, a middle section and an upper section, said pole having an upper end and a lower end, said upper end being associated with said upper section, said lower end being associated with said lower section, said lower section having a diameter being greater than a diameter of said upper section, said middle section having a top end insertably receiving said upper section, said upper end being rounded, said upper end having a slot extending toward said middle section to define a first finger being spaced from a second finger on said upper end, said first finger having a first hole extending laterally through said first finger, said second finger having a second hole extending laterally through said second finger, said first hole being aligned with said second hole;

a collar being rotatably integrated into said top end of said middle section, said collar extending around said upper section, said collar tightening against said upper section when said collar is rotated in a tightening direction, said collar loosening from said upper section when said collar is rotated in a loosening direction;

a trough being pivotally attached to said pole, said trough having a concave profile wherein said trough is configured to conform to the shape of a fire hose, said pole being vertically oriented on a support surface having said trough being spaced upwardly from the support surface wherein said trough is configured to support the fire hose in a manner that inhibits the fire hose from kinking when the fire hose is attached to a fire engine, said trough having a first end, a second end and an outer wall extending between said first end and said second end, said outer wall having a top side and a bottom side, said outer wall having a first edge extending between said first end and said second end, said outer wall having a second edge extending between said first end and said second end, said trough being elongated between said first end and said second end, said outer wall being concavely arcuate between said first edge and said second edge such that said first edge is spaced from said second edge, said first edge and said second edge each being straight between said first end and said second end such that said first edge and said second edge are coplanar, said trough having a pivot extending downwardly from said bottom side of said outer wall, said pivot being centrally positioned between said first end and said second end, said pivot being centrally positioned between said first edge and said second edge, said pivot having a first lateral side and a second lateral side, said pivot having an opening extending through said first lateral side and said second lateral side, said pivot being positionable in said slot in said upper end of said of said upper section of said pole having said opening being aligned with each of said first hole in said first finger and said second hole in said second finger wherein said top side of said outer wall is configured to support the fire hose; and a pin being extendable through said first hole in said first finger and said second hole in said second finger and said opening in said pivot for pivotally attaching said trough to said pole, said trough pivoting on pin for positioning said trough at a variety of angles with respect to an axis extending through said lower end and said upper end of said pole wherein said trough is configured to position the fire hose at an optimal orientation to inhibit the fire hose from kinking.

7. A fire hose support system for supporting a fire hose when the fire hose is attached to a fire engine, said assembly comprising:

a fire engine having an outlet;

a fire hose being fluidly coupled to said outlet of said fire engine;

a pole having a plurality of telescopic sections such that said pole has a telescopically adjustable length, said plurality of telescopic sections including a lower section, a middle section and an upper section, said pole having an upper end and a lower end, said upper end being associated with said upper section, said lower end being associated with said lower section, said lower section having a diameter being greater than a diameter of said upper section, said middle section having a top end insertably receiving said upper section, said upper end being rounded, said upper end having a slot extending toward said middle section to define a first finger being spaced from a second finger on said upper end, said first finger having a first hole extending laterally through said first finger, said second finger having a second hole extending laterally through said second finger, said first hole being aligned with said second hole;

a collar being rotatably integrated into said top end of said middle section, said collar extending around said upper section, said collar tightening against said upper section when said collar is rotated in a tightening direction, said collar loosening from said upper section when said collar is rotated in a loosening direction;

a trough being pivotally attached to said pole, said trough having a concave profile to conform to a shape of said fire hose, said pole being vertically oriented on a support surface having said trough being spaced upwardly from the support surface to support said fire hose in a manner that inhibits said fire hose from kinking when said fire hose is attached said outlet on said fire engine, said trough having a first end, a second end and an outer wall extending between said first end and said second end, said outer wall having a top side and a bottom side, said outer wall having a first edge extending between said first end and said second end, said outer wall having a second edge extending between said first end and said second end, said trough being elongated between said first end and said second end, said outer wall being concavely arcuate between said first edge and said second edge such that said first edge is spaced from said second edge, said first edge and said second edge each being straight between said first end and said second end such that said first edge and said second edge are coplanar, said trough having a pivot extending downwardly from said bottom side of said outer wall, said pivot being centrally positioned between said first end and said second end, said pivot being centrally positioned between said first edge and said second edge, said pivot having a first lateral side and a second lateral side, said pivot having an opening extending through said first lateral side and said second lateral side, said pivot being positionable in said slot in said upper end of said of said upper section of said pole having said opening being aligned with each of said first hole in said first finger and said second hole in said second finger such that said top side of said outer wall supports said fire hose; and a pin being extendable through said first hole in said first finger and said second hole in said second finger and said opening in said pivot for pivotally attaching said trough to said pole, said trough pivoting on pin for positioning said trough at a variety of angles with respect to an axis extending through said lower end and said upper end of said pole wherein said trough is configured to position the fire hose at an optimal orientation to inhibit the fire hose from kinking.

* * * * *